US005125387A

United States Patent [19]

De Wit et al.

[11] Patent Number: 5,125,387

[45] Date of Patent: Jun. 30, 1992

[54] DISTRIBUTORLESS IGNITION SYSTEM

[75] Inventors: Didier De Wit, Wavre, Belgium; Peter Howson, Brighton, England

[73] Assignee: Cooper Industries, Inc., Houston, Tex.

[21] Appl. No.: 722,781

[22] Filed: Jun. 28, 1991

[30] Foreign Application Priority Data

Jun. 29, 1990 [GB] United Kingdom ..... 9014561

[51] Int. Cl.[5] ..... F02P 7/03; F02P 7/73

[52] U.S. Cl. ..... 123/643; 123/146.50 A; 307/311

[58] Field of Search ..... 123/146.5 A, 613, 643, 123/654, 655, 656; 307/311

[56] References Cited

U.S. PATENT DOCUMENTS 3,501,600 3/1970 Saulmon ..... 200/19 DR X
4,993,395 2/1991 Vogel et al. ..... 123/643
5,002,034 3/1991 Herden et al. ..... 123/643

FOREIGN PATENT DOCUMENTS 108873 6/1984 Japan ..... 123/643

*Primary Examiner*—Tony M. Argenbright
*Attorney, Agent, or Firm*—Jackie Lee Duke; Alan R. Thiele; Nelson A. Blish

[57] ABSTRACT

This invention provides an ignition system for a spark initiated internal combustion engine such as an Otto cycle engine. High voltage pulses are generated, for instance by way of an ignition coil, and these are passed to the respective spark gaps by way of semiconductor switches. These semiconductor switches are preferably bulk photoconductive switch devices which each comprise a light source and a photosensitive switch. These devices are under the control of control circuitry which activates and deactivates the light sources approximately to distribute the high voltage pulses to the spark plugs. These switches may be used to improve the rise time of the potential across the spark gap or to generate a plurality of sparks in one gap from a single pulse.

9 Claims, 2 Drawing Sheets

DISTRIBUTORLESS IGNITION SYSTEM

BACKGROUND

The present invention relates to a static spark distributor system suitable for distributing the ignition spark that initiates combustion of fuel and air compressed in the cylinders of a multi cylinder spark initiated internal combustion engine such as an Otto cycle engine. High voltage ignition pulses produced by, for instance, an ignition coil are directed to the respective sparking device of the cylinder by electronically switching the energy from the secondary winding of the ignition coil by means of a bulk photoconductive switch, thereby eliminating the need to drive a mechanical switch or use multiple or special ignition coils to distribute the ignition spark.

Multi cylinder engines of the type mentioned above have by tradition utilized a single ignition coil Kettering ignition system to provide the spark and a mechanical switch to distribute the spark to each cylinder in turn as depicted in FIG. 1. By far the most common type of mechanical switch is the distributor cap and roto arm.

In an ignition coil, current from a battery or a generator flows through a primary winding of the ignition coil, producing a strong magnetic field. At the ignition point, a contact breaker interrupts the current, the magnetic field collapses and induces the high voltage pulse required to produce a spark for the ignition in a secondary winding of the ignition coil. This is then passed to the distributor and from there to the appropriate sparking plug.

The distributor cap consists of high quality bakelite or epoxy resin molded into a bowl shaped distributor housing into which is set an annular series of equally spaced brass conductors. The distributor rotor arm is also molded from a similar electrical insulator material and has an electrode mounted along the center of the molding which is mounted onto either a shaft driven by the camshaft or directly to the camshaft and rotates inside the distributor cap. A spring loaded brush is mounted in the center of the cap and makes contact with the center of the roto arm. This brush is connected to the ignition coil secondary winding and the annular electrodes in the cap to each spark plug.

Spark distribution is achieved by rotating the arm inside the cap and triggering the ignition system as the arm which typically has a 0.5 mm clearance between the arm, and annular electrodes, aligns with one of the annular electrodes. The surge of ignition current jumps the 0.5 mm gap and passes to the spark plug. Hence as the arm rotates ignition energy is transferred from the coil to each of the spark plugs in turn.

Although the method is very simple and economic a number of disadvantages are inherent. Electrical processes in the cap such as arcs and glow discharge produce nitric oxide and ozone which corrodes the electrodes and attack the electrical insulation especially in a damp climate, hence failures are common. Other disadvantages are that peak ignition voltages are limited to 30 kv and that radio frequency interference (RFI) is generated by the spark discharge present between the rotor arm and the distributor cap electrodes.

Recently efforts have been directed towards distributorless ignition systems where in the necessary switching of the spark current is performed electronically by means other than a rotor arm and contact. The advantage of this over the mechanical means include reduction in radio frequency interference.

In some previous distributorless systems switching has not been performed on the high voltage secondary side of the coil. In some of these systems a more complicated coil is provided with multiple windings associated with high voltage diodes (several spark plugs connected to the same secondary coil winding), plug selection is made by using energy polarization. For example, the primary winding of the coil is divided and the secondary is isolated from the primary, two power output stages are arranged to alternately pass current from the center tap and trigger the coil. Each end of the secondary winding is connected to two anti-parallel high voltage diodes in series with each spark plug, that conduct in pairs as a function of the direction of the primary current. In such a system each secondary winding provides a spark in each of two cylinders, at the moment when one of the two is at the point where it requires a spark for combustion. At this moment the other of the two is in the exhaust phase when the presence of a spark will make no difference. Each half of the primary winding is switched in turn, using transistors, to provide the correct sparks in the cylinders.

Another proposed distributorless system utilizes multiple coils (one coil per spark plug) and is generally referred to as "The coil on the plug system." Fundamentally the system consists of a small ignition coil fitted directly to the top of each sparking device. Spark distribution is achieved by activating each ignition coil when the spark is required at that particular sparking device. It has been claimed that the system reduces RFI, increases reliability and allows a wider spark advance range. However the cost is high since one ignition coil is required for each cylinder.

Descriptions of prior art systems of the types described above can be found in U.S. Pat. Nos. 4,556,040; 4,664,092; 3,577,971; and 4,411,247.

A further proposed distributorless system replaces the rotor arm/contact arrangement of a conventional distributor with a bank of high voltage reed switches. The spark is produced by an ignition coil and this is switched to the appropriate sparking device by the appropriate reed switch under the control of a computer. This has as an input a synchronizing signal to indicate the correct firing sequence.

Thus, in attempting to produce a distributorless ignition system, three approaches have been taken. One is to replace the mechanical switching means with electromagnetic switches such as reed switches while utilizing, for instance the conventional ignition coil. However such switches capable of coping with the voltage generated by the secondary winding have been relatively expensive. A second approach has been to perform the switching in the low voltage part of the circuitry, but this leads to complications, such as those described above, with regard to the necessary coil configuration and such systems cannot operate with odd numbers of cylinders. The third approach of providing one ignition coil for each cylinder is expensive both in terms of the cost of the coils and associated drive circuitry.

SUMMARY

The present invention provides an ignition system for a spark initiated internal combustion engine comprising a plurality of semiconductor switch devices each arranged to be connected between a source of high voltage pulses and a respective sparking device, and a control circuit for controlling the respective switch devices in order to distribute the pulses to the sparking devices.

Preferably the semiconductor high voltage switches are bulk photoconductive switch devices (BPSD). A BPSD is a semiconductor switch which contains photosensitive material which changes its electrical resistance according to the intensity of electromagnetic (EM) radiation falling on it. When the EM radiation intensity is high, the electrical resistance is relatively low, and when the EM radiation intensity is low, the electrical resistance is relatively high. A BPSD device also comprises a EM radiation source which is electrically isolated from the photosensitive material and which has separate circuit to control its intensity. Thus when the switch is put in a circuit, controlling the intensity of the EM radiation source will switch the current in the circuit.

Preferably, the high voltage source of the present invention is a conventional ignition coil. The control circuit may be part of a microprocessor engine management system, or it may be dedicated logic circuitry.

In a preferred embodiment the signal necessary to be input to the control circuit to synchronize it with the cylinder position is derived in a conventional manner from the engine advance/retard mechanism of a prior art distributor.

Thus, an advantage of the invention is that it provides in a preferred embodiment a simple replacement for the function of the mechanical rotor arm and contacts of a distributor while utilizing other elements of a conventional ignition system.

Another advantage of the preferred embodiment of the present invention is that the switching control circuitry is electrically isolated from the switched high voltage.

BRIEF DESCRIPTION OF THE DRAWINGS

Further features and advantages of the present invention will become apparent from the following description of a preferred embodiment with reference to the accompanying drawings in which.

DESCRIPTION OF THE PREFERRED EMBODIMENT

Figure 1:
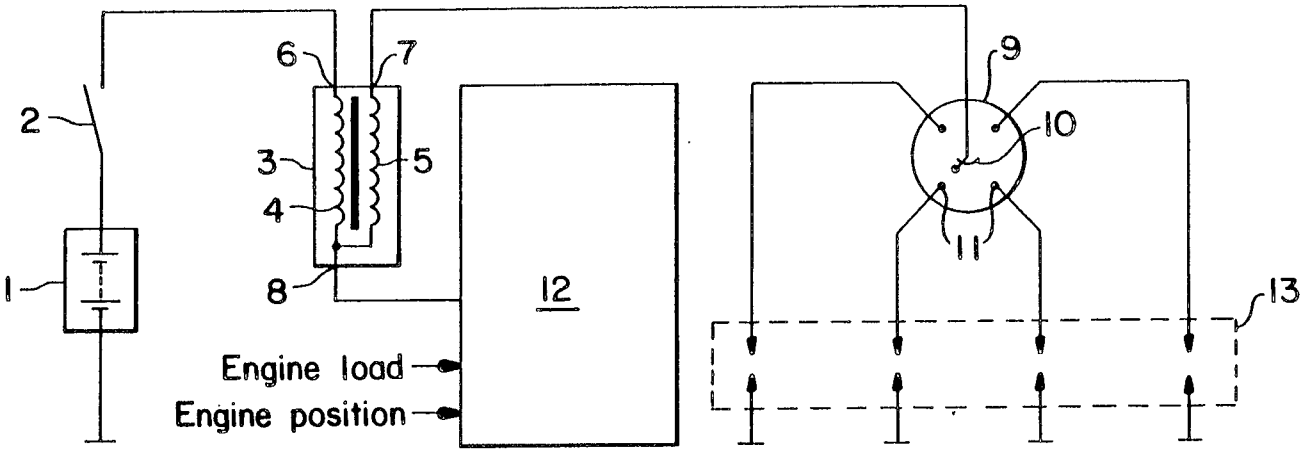
FIG. 1 PRIOR ART
FIG. 1 shows a conventional ignition system utilizing a mechanical distributor.

FIG. 1 shows a conventional ignition system utilizing a mechanical distributor. The system comprises a battery 1 connected to a first end 6 of the primary winding 4 of the ignition coil 3 via a switch 2 representative of the ignition switch of an engine. Other conventional circuitry associated with starting an engine is not shown as it is not directly relevant to this invention. A first end 7 of the secondary winding 5 of the ignition coil 3 is connected to the rotor arm 10 of a distributor 9. The second ends 8 of the primary 4 and secondary 5 winding of the ignition coil 3 are connected together and are also connected to the control circuitry 12.

The control circuitry 12 also receives as inputs signals indicating, for example, engine position and loading conditions. These may be derived from the mechanical advance/retard mechanism of the distributor 9. At appropriate times in the engine cycle, the control circuitry 12 causes ignition coil 3 to provide a high voltage pulse, and the position of the rotor arm 10 in relation to the contacts 11 in distributor 9 dictates to which spark gap 13 the pulse is sent.

Figure 2:
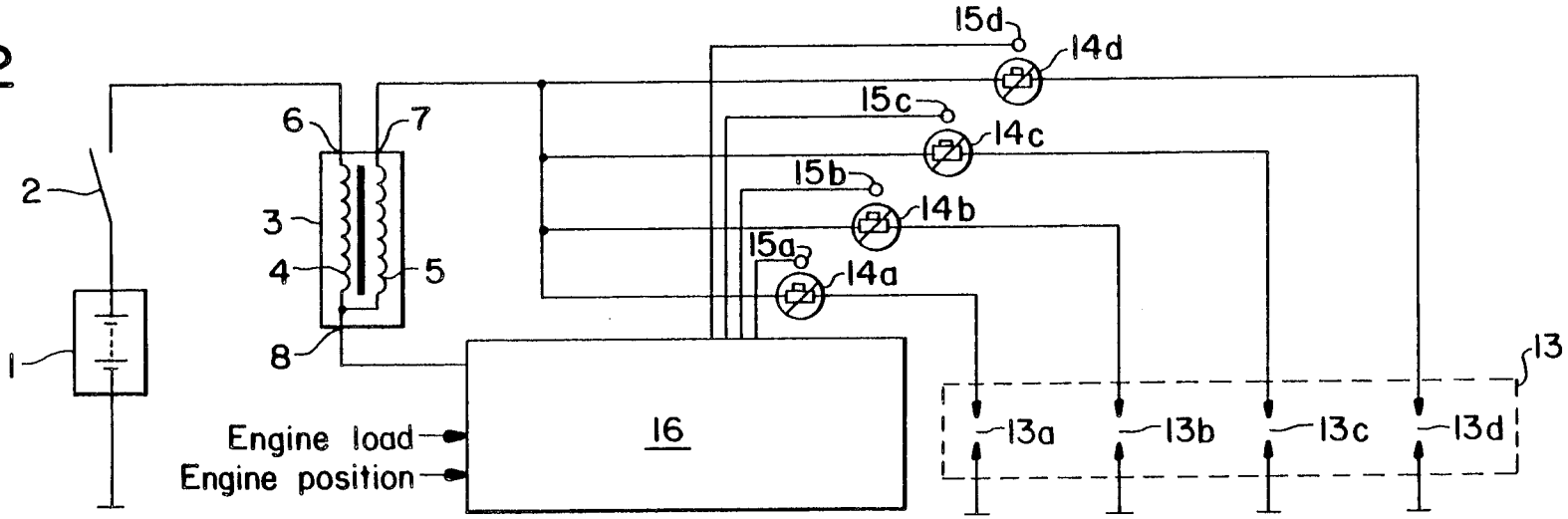
FIG. 2 shows a distributorless ignition system according to the one embodiment of the present invention.

FIG. 2 shows an embodiment of an system according to the present invention which utilizes many of the same parts as the conventional system shown in FIG. 1. The same reference numbers are used to identify the same parts. The system also comprises bulk photoconductive switch devices comprising semiconductor switches 14 and EM radiation sources 15. The invention is operable with any source of high voltage pulses and is illustrated using a conventional ignition coil 3.

In FIG. 2 the first end 7 of the secondary winding 5 of the ignition coil 3 is connected to one electrode of each of semiconductor switches **14*a*, 14*b*, 14*c*, 14*d* in the bulk photoconductive switch devices. The other electrode of each semiconductor switch 14*a*, 14*b*, 14*c*, 14*d* is connected to a respective spark gap 13*a*, 13*b*, 13*c*, 13*d* so that each semiconductor switch 14*a*, 14*b*, 14*c*, 14*d* is connected in series between a respective spark gap 13*a*, 13*b*, 13*c*, 13*d* and the secondary winding 5 of the ignition coil 3**.

As in FIG. 1 the second ends 8 of the primary 4 and secondary 5 winding of the ignition coil 3 are connected together. They are also connected to control circuitry 16 along with inputs carrying signals indicative of such parameters as engine load position. Control circuitry 16 is also connected to the EM radiation sources **15*a*, 15*b*, 15*c*, 15*d* associated with the semiconductor switches 14*a*, 14*b*, 14*c*, 14*d*** in the bulk photoconductive switch devices.

The signal indicating, for example, engine position and loading conditions may be dervied in similar manner to the conventional system above, and may actually be derived from the mechanical advance/retard mechanism of a conventional distributor assembly. This would be possible in the case that a conventional system were modified according to the present invention and the original distributor was left in place.

In similar manner to the system of FIG. 1, the control circuitry 16 causes ignition coil 3 to provide high voltage pulses at the appropriate times in the engine cycle. However, the control circuitry 16 also provides signals to activate the EM radiation sources 15 of the bulk photoconductive switch devices. These are coordinated with the production of the high voltage pulses such that when a particular one of the sparking gaps 13 requires a pulse to produce a spark, the corresponding one of the semiconductor switches 15 is brought into a conductive state and a pulse is generated by the ignition coil 3.

In the dark state, each bulk photoconductive switch device offers approximately 100 to 15,000 M ohms of electrical resistance to the ignition coil which effectively reduces the spark current to a negligible value. A small leakage current will pass the bulk photoconductive switch device which may cause a build up of potential across the spark gaps 13 but this can be prevented by connecting a shunt resistance across the spark gap.

The control circuit 16 activates each EM radiation source 15 in turn, in accordance with the required sparking sequence. This reduces the bulk photoconductive switch resistance to approximately 20–50 K ohms. This value of resistance is deliberately selected to suppress RF interference generated when the sparking device sparks and causes subsequent oscillation of the system, in the same manner as a conventional RF suppression resistor. The relatively low resistance of the bulk photoconductive switch in the EM radiation irradiated state allows the passage of current hence causing the gap to spark.

Such semi-conductor switches can be brought very rapidly into the conductive sate from the nonconductive sate and this fact can be used to provide further advantages over a typical ignition coil/distributor system. This will be described in relation to FIG. 3.

Figure 3:
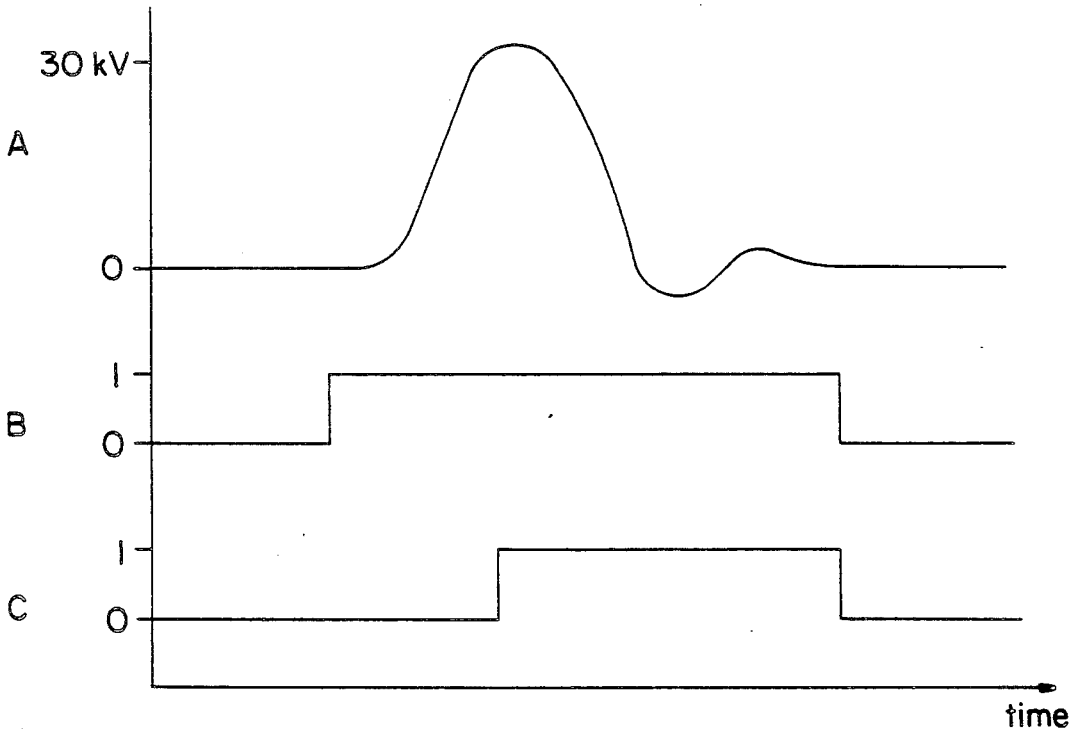
FIG. 3 illustrates the operation of the switches of the present invention.

FIG. 3 is a timing diagram for the operation of the sparking system. FIG. 3A illustrates a typical high voltage pulse produced by a conventional ignition coil which has a peak voltage of approximately 30 kV. FIGS. 3B and 3C illustrate the operation of the bulk photoconductive switch devices where "0" indicates the un-activated nonconductive state, and "1" indicates the activated conductive state.

One mode of operation uses the timing illustrated in FIG. 3B. When a pulse is due to be applied to a spark gap, the switch is brought into conduction before the production of the pulse and is deactivated after the end of the pulse. Thus the complete pulse produced by the ignition coil is applied to the spark gap, as is the case with the mechanical distributor. The time taken for the potential across the spark gap to rise to its maximum is typically 100–150 μs using an ignition coil and is typically 25 μs in a capacitor discharge system.

In the spark plug, energy is lost due to the leakage resistance during the time between the start of the pulse and the time at which the potential is great enough to break down the spark gap. Thus, this energy loss can be reduced by reducing the time taken for the potential across the spark gap to rise to its maximum.

This can be achieved using the timing illustrated in FIG. 3C, which is representative of another mode of operation.

In FIG. 3C, the switch is not activated until the pulse produced by the coil has approximately reached its peak. In this case the rise time of the potential across the spark gap is limited only by the speed at which the switch can be brought into conduction. Thus the rise time of the potential across the spark gap may be reduced to 5–10 μs, so reducing the energy lost as described above.

In such a system the control circuitry is arranged so that the ignition coil is activated earlier than it otherwise would be in order that the pulse has reached its peak at the moment the spark is required in the spark gap.

Another factor which tends to increase the rise time of the potential across the spark gap is the capacitance present in the line to the spark gap. This capacitance can be reduced by placing the switch as close as possible to the spark gap. Int his arrangement the capacitance of the spark lead is effectively charged up prior to the activating of the switch and hence has little effect after the activating of the switch.

It is also possible to activate and deactivate the switch rapidly a plurality of times during a single pulse from the ignition coil and this can generate more than one spark in each spark gap from a single pulse.

A suitable bulk photoconductive switch device for use in this system is a device comprising a photosensitive semiconductor and a EM radiation source which when actuated, irradiates the semiconductor and causes the latter to become conductive, in which the photosensitive semiconductor is a sintered mixture comprising by weight 63 to 74% of cadmium, 16 to 24% of selenium, 8 to 14% of sulphur, 0.1 to 1% of chlorine, and 0.005 to 0.1% of copper.

In such a device, the semiconductor may be in the form of an adherent layer on an electrically insulating substrate, together forming a hollow cylinder. The EM radiation source, for example one or more light emitting diodes, would then be placed on the longitudinal axis of the cylinder in order to irradiate the photosensitive semiconductor. Such devices generally function using visible light and infra-red radiation, typically with the wave length in the range of 200–1500 nm. It has been found that devices of this type work particularly well with visible light and near infra-red EM radiation with a s wave length between 500–900 nm.

Under test, a typical such bulk photoconductive switch was connected alone to a conventional ignition system and pulsed at a rate of 50 Hz. the device showed no signs of damage after 120 hours when the pulsed peak rate was 70 mA. The estimated energy of each pulse was 45 mJ and power dissipated in the semiconductor material was 2.2 W.

This embodiment has been described as a simple replacement for the mechanical distributor in a conventional ignition system, but it is clear that the invention includes many variations. For instance some or all of the described devices, such as the control circuitry, means for generating the control circuit inputs and the bulk photoconductive switch devices amy be solid state devices, and may or may not be generated by known methods other than the ignition coil described above. Further, the control circuitry may be part of a microprocessor based engine management system on dedicated hard wired logic.

What is claimed is:

1. An ignition system for a spark initiated internal combustion engine comprising a plurality of semiconductor switch devices each arranged to be connected between a source of high voltage pulses and a respective sparking device, and a control circuit for controlling the respective switch devices in order to distribute the pulses to the sparking devices, wherein the semiconductor switch devices are bulk photoconductive switch (BPCS) devices comprising a photosensitive semiconductor switch and at least one light emitting diode radiating infra-red light with a wave length between 500–900 nm, said light emitting diode under the control of the control circuit.

2. An ignition system according to claim 1 wherein the resistance of the semiconductor switch when the light source is not activated is in the range of 100–15,000 M ohms.

3. An ignition system according to claim 2 wherein the resistance of the semiconductor switch when the electromagnetic radiation source is activated is in the range of 25–40 k ohms.

4. An ignition system according to claim 3 wherein the source of high voltage pulses is an ignition coil.

5. An ignition system according to any of claims 1 or 2–4 wherein one of the semiconductor switches is activated prior to a respective high voltage pulse being generated.

6. An ignition system according to any of claims 1 or 2–4 where one of the semiconductor switches is activated after a respective high voltage pulse is applied to the switch whereby to reduce the rise time of the potential at the output of the switch.

7. An ignition system according to any of claims 1 or 2–4 wherein one of the semiconductor switches is activated and deactivated a plurality of times during one high voltage pulse.

8. An ignition system for a spark initiated internal combustion engine comprising a plurality of semiconductor switch devices each arranged to be connected between a source of high voltage pulses and a respective sparking device, and a control circuit for controlling the respective switch devices in order to distribute the pulses to the sparking devices wherein the semiconductor switch devices are bulk photoconductive switch (BPCS) devices comprising a photosensitive semiconductor switch and an electromagnetic radiation source the latter being under the control of the control circuit where one of the semiconductor switches is activated prior to a respective high voltage pulse being generated.

9. An ignition system for a spark initiated internal combustion engine comprising a plurality of semiconductor switch devices each arranged to be connected between a source of high voltage pulses and a respective sparking device, and a control circuit for controlling the respective switch devices in order to distribute the pulses to the sparking devices wherein the semiconductor switch devices are bulk photoconductive switch (BPCS) devices comprising a photosensitive semiconductor switch and an electromagnetic radiation source the latter being under the control of the control circuit where one of the semiconductor switches is activated after a respective high voltage pulse is applied to the switch whereby to reduce the rise time of the potential at the output of the switch.

* * * * *